US011815294B2

(12) United States Patent
Jang et al.

(10) Patent No.: US 11,815,294 B2
(45) Date of Patent: Nov. 14, 2023

(54) ENGINE SYSTEM

(71) Applicant: LG ELECTRONICS INC., Seoul (KR)

(72) Inventors: Heejoong Jang, Seoul (KR); Hojong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/527,647

(22) Filed: Nov. 16, 2021

(65) Prior Publication Data

US 2022/0154979 A1 May 19, 2022

(30) Foreign Application Priority Data

Nov. 17, 2020 (KR) ..... 10-2020-0153831

(51) Int. Cl.

| | |
|---|---|
| ***F25B 1/02*** | (2006.01) |
| ***F02B 29/04*** | (2006.01) |
| ***F02B 37/18*** | (2006.01) |
| ***F02M 21/02*** | (2006.01) |
| ***F02B 31/04*** | (2006.01) |

(52) U.S. Cl.

CPC ..... *F25B 1/02* (2013.01); *F02B 29/0437* (2013.01); *F02B 31/04* (2013.01); *F02B 37/18* (2013.01); *F02M 21/0212* (2013.01); *F02M 21/0215* (2013.01); *F25B 2327/001* (2013.01)

(58) Field of Classification Search

CPC ..... F02M 21/0215; F02M 21/0212; F02B 29/04; F25B 1/02

See application file for complete search history.

(56) References Cited

U.S. PATENT DOCUMENTS

| | | | | |
|---|---|---|---|---|
| 4,161,931 | A * | 7/1979 | Giardini | F02M 31/18 123/556 |
| 2005/0262842 | A1* | 12/2005 | Claassen | F02M 26/28 60/618 |
| 2012/0222420 | A1* | 9/2012 | Geskes | F02M 26/05 60/618 |
| 2013/0219880 | A1* | 8/2013 | Irmler | F01K 7/16 165/166 |

FOREIGN PATENT DOCUMENTS

| | | |
|---|---|---|
| KR | 10-2017-0035445 | 3/2017 |
| KR | 10-2020-0067125 | 6/2020 |

* cited by examiner

*Primary Examiner* — Kevin A Lathers

(74) *Attorney, Agent, or Firm* — KED & ASSOCIATES, LLP

(57) ABSTRACT

Provided is an engine system. The engine system includes a mixer mixing air and vaporized fuel to form a mixture, an engine driving a cylinder with the mixture discharged from the mixer, a first storage tank supplying the vaporized fuel to the mixer, a second storage tank storing liquid fuel or supplying the stored liquid fuel to the first storage tank, and a heat exchanger performing heat exchange between the liquid fuel discharged from the first storage tank and gas flowing to the engine, thus vaporizing the liquid fuel.

19 Claims, 8 Drawing Sheets

ENGINE SYSTEM

CROSS-REFERENCE TO RELATED PATENT APPLICATIONS

This application claims priority to Korean Patent Application No. 10-2020-0153831, filed Nov. 17, 2020, whose entire disclosures are hereby incorporated by reference.

BACKGROUND OF THE DISCLOSURE

Field of the Disclosure

The present disclosure relates to an engine system and, more particularly, to an engine system included in a gas-engine heat pump to drives a heat pump with the engine system.

Related Art

A gas-engine heat pump is a device that drives a gas engine to drive a compressor. This connects the engine and the compressor via a belt, and drives the compressor to circulate refrigerant in the heat pump.

The gas engine may be a device that is driven by a plurality of cylinders to burn fuel, and supplies a mixture of air and fuel to the plurality of cylinders, thus driving the cylinders. The fuel supplied to the cylinder may be supplied at a low temperature to be supplied to the cylinder in a high-density state. To this end, a process for cooling the mixture supplied to the cylinder may be required.

Further, the fuel supplied to the cylinder may be supplied in a supercharged state. When the temperature of the mixture becomes high in a supercharging process, a process for cooling the mixture may be required.

Korean Patent Laid-Open Publication No. 10-2020-0067125 has disclosed an intercooler that cools the mixture as a separate cooling source, when the mixture mixed in a mixer is supplied to the engine. Here, the intercooler is configured to lower the temperature of the mixture through outside air or coolant. This is problematic in that the separate cooling source should be provided.

Further, some of exhaust gas discharged from the engine may be recirculated, thereby reducing the amount of carbon or nitrogen oxide emitted to the outside. At this time, air supplied to the engine by recirculation is hot exhaust gas, so that a cooling process is required to supply the recirculated air to the engine.

Korean Patent KR 10-2017-0035445 has disclosed a recirculation pipe that recirculates some of exhaust gas to an engine, and an EGR cooler that reduces the temperature of exhaust gas flowing through the recirculation pipe.

However, a structure in which the EGR cooler for cooling the exhaust gas cools the exhaust gas is not described in detail. As for the cooling method of the EGR cooler, a separate cooling source should be provided when the exhaust gas is cooled through outside air or coolant like the above-mentioned intercooler.

SUMMARY

The present disclosure provides an engine system that cools fuel supplied to an engine using the fuel supplied to a mixer, thus maximizing the performance of the engine.

The present disclosure also provides an engine system capable of cooling a mixture supplied to an engine using a phase change in fuel supplied to the engine, without a separate refrigerant or coolant for cooling.

The present disclosure also provides an engine system provides an engine system that maximizes the performance of an engine by cooling gas exhausted and recirculated from the engine, using fuel supplied to a mixer.

Technical objects to be achieved by the present disclosure are not limited to the aforementioned technical objects, and other technical objects not described above may be evidently understood by a person having ordinary skill in the art to which the present disclosure pertains from the following description.

In an aspect, an engine system is provided. The engine system may include a mixer mixing air and vaporized fuel to form a mixture, an engine driving a cylinder with the mixture discharged from the mixer, a first storage tank supplying the vaporized fuel to the mixer, a second storage tank storing liquid fuel or supplying the stored liquid fuel to the first storage tank, and a heat exchanger performing heat exchange between the liquid fuel discharged from the first storage tank and gas flowing to the engine, thus vaporizing the liquid fuel. Thereby, the liquid fuel supplied to the mixer may be vaporized and the mixture supplied to the engine may be cooled.

The heat exchanger may be disposed between the mixer and the engine to perform heat exchange between the mixture fed from the mixer to the engine and the liquid fuel flowing from the second storage tank to the first storage tank. Thereby, the mixture supplied to the engine may be cooled.

The engine system may further include a supercharger compressing the mixture flowing from the mixer to the engine, and the heat exchanger may be disposed between the supercharger and the engine to reduce a temperature of the mixture flowing to the engine. Thereby, the mixture that is increased in temperature while passing through the supercharger may be cooled The engine system may further include an exhaust-gas recirculation pipe defining a recirculation path to supply gas discharged from the engine to the mixer. Thereby, the mixture mixed with hot exhaust gas introduced into the recirculation pipe may be cooled.

The exhaust-gas recirculation pipe is connected to an air inlet pipe that supplies air to the mixer.

The engine system may further include a re-liquefaction device liquefying fuel discharged from the second storage tank, and a pump supplying the fuel, discharged from the re-liquefaction device, to the heat exchanger. Thereby, the ratio of liquid in the fuel supplied to the heat exchanger may be increased.

The engine system may further include a first pipe connected to a bottom of the second storage tank to send the liquid fuel stored in the second storage tank to the re-liquefaction device, and a second pipe connected to a top of the second storage tank to send the gas fuel discharged from the second storage tank to the re-liquefaction device. Thereby, the fuel discharged from the second storage tank may be liquefied.

A compressor may be disposed in the second pipe to compress the gas fuel introduced into the re-liquefaction device. Thereby, the gas fuel supplied to the re-liquefaction device may be compressed to be easily liquefied.

The engine system may further include a third pipe connecting the re-liquefaction device and the heat exchanger, and a fourth pipe branching from the third pipe and connected to the second storage tank. Thereby, some of the liquid fuel discharged from the re-liquefaction device may be supplied to the heat exchanger, and the remaining liquid fuel may be re-introduced into the second storage tank.

The pump may be disposed on the third pipe before the fourth pipe is branched, so that it is possible to supply the liquid fuel discharged from the re-liquefaction device to the heat exchanger or the second storage tank.

The engine system may further include an expansion valve expanding the liquid fuel discharged from the second storage tank and supplied to the heat exchanger. Thereby, the liquid fuel supplied to the heat exchanger may be made to be easily vaporized.

The expansion valve may be disposed on the third pipe after the fourth pipe is branched, so that it is possible to expand the liquid fuel supplied to the heat exchanger.

The engine system of claim may further include an exhaust-gas recirculation pipe defining a recirculation path to supply gas, discharged from the engine, to the mixer, and the heat exchanger may be disposed on the exhaust-gas recirculation pipe so that the liquid gas exchanges heat with the exhaust gas flowing in the recirculation path to be vaporized. Thereby, hot exhaust gas supplied to the exhaust-gas recirculation pipe may be cooled, and fuel supplied from the second storage tank may be vaporized.

The exhaust-gas recirculation pipe may be connected to the air inlet pipe that supplies air to the mixer, and the engine system may further include a supercharger compressing the mixture flowing from the mixer to the engine.

The engine system may further include a zero governor supplying the gas fuel stored in the first storage tank to the mixer at a predetermined pressure. Thereby, the pressure of the gas fuel supplied to the mixer may be maintained.

The heat exchanger may include a plurality of small-diameter pipes in which gas flowing to the engine flows, and a housing formed around the plurality of small-diameter pipes, and defining a space in which liquid fuel flows so that heat exchange is performed between the liquid fuel and the mixture. Thereby, heat exchange may be performed between the small-diameter pipes disposed in the housing and defining the path of gas flowing to the engine, and the liquid fuel flowing around the small-diameter pipes. Further, an inlet pipe and an outlet pipe may be formed on a side of a circumferential surface of the housing, the liquid fuel being introduced into the inlet pipe, the gas fuel exchanging heat with gas that flows in the plurality of small-diameter pipes to discharge phase-changed gas fuel.

The housing may be disposed to be inclined downwards from upstream to downstream in a flow direction of the gas flowing to the engine, and the inlet pipe and the outlet pipe may be formed on the circumferential surface of the housing to protrude upwards. Thereby, only the vaporized fuel may flow through the outlet pipe.

The outlet pipe may be disposed at a position higher than the inlet pipe, so that the vaporized gas fuel may flow through the outlet pipe.

The heat exchanger may further include a drain pipe disposed downstream of the housing in the flow direction of the gas flowing to the engine, and discharging condensate water of the mixture produced in the housing. Thereby, it is possible to discharge the condensate water produced in the housing to the outside.

The drain pipe may include a first drain pipe collecting the condensate water accumulated in the housing, and a second drain pipe extending to be disposed above the first drain pipe so as to prevent the gas flowing to the engine from being discharged to the drain pipe, the first drain pipe may be disposed to be lower than the lower end of the housing, and the second drain pipe may be disposed downstream of the first drain pipe and be disposed above the first drain pipe. Thereby, only the condensate water is discharged through the drain pipe, and gas flowing in the housing is not discharged to the outside.

Other specific details of the present disclosure are included in the detailed description and drawings.

DESCRIPTION OF EXEMPLARY EMBODIMENTS

Figure 1:
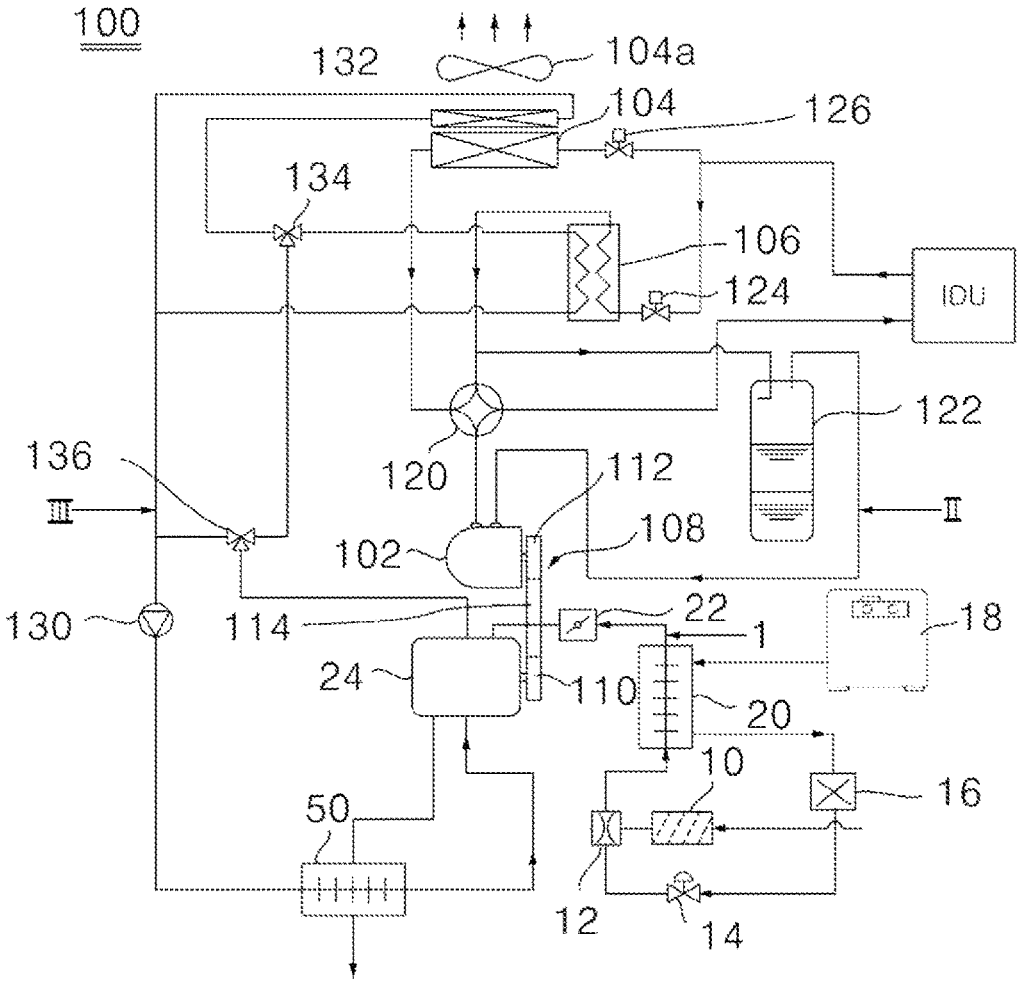
FIG. 1 is a schematic view of a gas-engine heat pump including an engine system in accordance with a first embodiment of the present disclosure.

The above and other objectives, features, and other advantages of the present disclosure will be more clearly understood from the following detailed description when taken in conjunction with the accompanying drawings. However, the disclosure may be embodied in different forms without being limited to the embodiments set forth herein. Rather, the embodiments disclosed herein are provided to make the disclosure thorough and complete and to sufficiently convey the spirit of the present disclosure to those skilled in the art. The present disclosure is to be defined by the claims. Like reference numerals refer to like parts throughout various figures and embodiments of the present disclosure.

Hereinafter, engine systems and gas-engine heat pumps including the engine systems according to embodiments of the present disclosure will be described First, the gas-engine heat pump including the engine system will be described in brief with reference to FIG. 1.

The gas-engine heat pump 100 according to this embodiment includes an engine system 1 that drives an engine 24 with mixed gas (hereinafter referred to as a 'mixture') of gas and air, a heat pump II that drives a compressor 102 by the operation of the driven engine 24 to circulate a refrigerant, and a coolant circulator III that circulates a coolant for cooling the engine 24.

The engine system 1 may drive the engine 24 operated by combustion, and may drive the compressor 102 connected to the engine 24 via a pulley and a belt. An engine-side driving pulley 110 is disposed on one side of the engine 24. A detailed configuration of the engine system 1 will be described below in detail with reference to FIGS. 2 and 3. Referring to FIG. 1, the heat pump II includes the compressor 102 that is connected to the engine 24 to drive the engine and compresses the refrigerant, an outdoor heat exchanger 104 that is disposed in an outdoor space to perform heat exchange between the outdoor air and the refrigerant, a plate-shaped heat exchanger 106 that is disposed in the outdoor space to perform heat exchange between the refrigerant and the coolant, and an indoor unit IDU that is disposed in an indoor space to perform heat exchange between the air of the indoor space and the refrigerant and thereby control the temperature of the indoor space.

The compressor 102 may be driven by a drive transmission unit 108 that transmits the driving force of the engine 24. The drive transmission unit 108 may be connected to the engine 24 via a pulley and a belt to be driven.

The drive transmission unit 108 may include the engine-side driving pulley 110 that is connected to the engine 24 to be rotated by the driving of the engine 24, a compressor-side driving pulley 112 that is connected to the compressor 102 to drive the compressor 102 through rotation, and a belt 114 that connects the engine-side driving pulley 110 and the compressor-side driving pulley 112.

The heat pump II may use the outdoor heat exchanger 104 as a condenser in a cooling mode, and may use the plate-shaped heat exchanger 106 as an evaporator in a heating mode. In the outdoor heat exchanger 104, the refrigerant may perform heat exchange with the outside air flowing to the outdoor fan 104*a*. A heat dissipator 132 which will be described below may be disposed on one side of the outdoor heat exchanger 104.

Referring to FIG. 1, the heat pump II may further include a four-way valve 120 that supplies the refrigerant discharged from the compressor 102 to the outdoor heat exchanger 104 or the indoor unit IDU, and an accumulator 122 that separates the refrigerant introduced into the compressor 102 to supply the gas-phase refrigerant to the compressor 102.

The accumulator 122 sends the gas-phase refrigerant among the refrigerant introduced through a four-way valve 120 to the compressor 102.

The gas-engine heat pump 100 may further include a first expansion valve 124 that expands refrigerant introduced into the plate-shaped heat exchanger 106, and a second expansion valve 126 that expands refrigerant discharged from the outdoor heat exchanger 103.

Referring to FIG. 1, the coolant circulator III includes a coolant pump 130 that forms the flow of the coolant, a heat dissipator 132 that performs heat exchange between the coolant and the outdoor air, a first three-way valve 134 that sends the coolant circulated by the coolant pump 130 to the heat dissipator 132 or the plate-shaped heat exchanger 106, and a second three-way valve 136 that sends the coolant circulated by the coolant pump 130 to the first three-way valve 134 or the coolant pump 130. The coolant circulator III may further include an exhaust-gas heat exchanger 50 that performs heat exchange between gas exhausted from the engine 24 and the coolant.

The heat dissipator 132 may be disposed on one side of the outdoor heat exchanger 104 to perform heat exchange between the coolant and the outside air flowing to the outdoor fan 104*a*.

Hereinafter, the engine system according to the first embodiment of the present disclosure will be described with reference to FIG. 2.

The engine system 1 drives the engine 24 with the mixture to drive the compressor. Here, the mixture refers to gas produced by mixing air and gas fuel at a predetermined ratio. The mixture may be produced by mixing the air and the gas fuel through a mixer 12 that will be described below.

The engine system 1 includes the engine 24 that is operated through the combustion of the mixture, a first storage tank 16 that temporarily stores gas fuel supplied to the engine 24, a second storage tank 18 that stores liquid fuel, a heat exchanger 20 that performs heat exchange between the liquid fuel discharged from the second storage tank 18 and the mixture supplied to the engine 24 to perform vaporization, and the mixer 12 that mixes the gas-phase refrigerant supplied from the first storage tank 16 and air and then sends the mixture to the engine 24.

The first storage tank 16 may temporarily store the gas fuel flowing from the heat exchanger 20. A zero governor 14 may be disposed in the engine system 1 to supply the gas fuel stored in the first storage tank 16 to the mixer 12 at a predetermined pressure.

The zero governor 14 always supplies the gas fuel to the mixer 12 at a constant pressure regardless of a change in flow rate or pressure of the fuel introduced into the zero governor 14. The zero governor 14 may obtain a stable head pressure over a wide range, and may adjust the pressure of the gas fuel supplied to the engine 24 to be almost constant in the form of atmospheric pressure. Furthermore, the zero governor 14 may be provided with a plurality of valves (not shown) to block the supplied fuel.

The second storage tank 18 may store the liquid fuel. The second storage tank 18 may use the form of a pressure tank to store the fuel in a liquid state. The second storage tank 18 may include a tank of a double structure (not shown) and a heat insulator (not shown).

Figure 3:
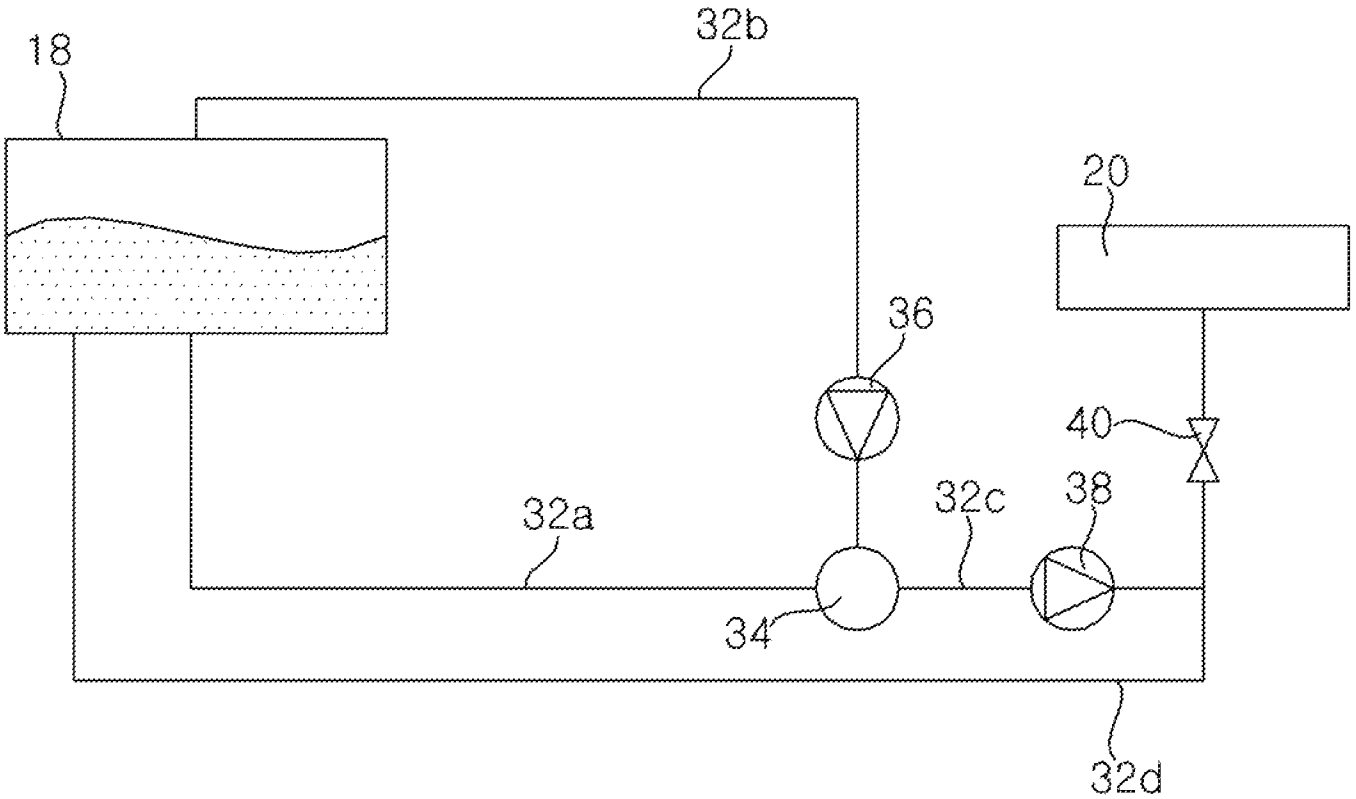
FIG. 3 is a diagram illustrating a configuration disposed between a second storage tank and a heat exchanger in accordance with an embodiment of the present disclosure.

Referring to FIG. 3, a re-liquefaction device 34 configured to re-liquefy fuel discharged from the second storage tank 18 and a pump 38 configured to supply the fuel discharged from the re-liquefaction device 34 to the heat exchanger 20 may be disposed between the second storage tank 18 and the heat exchanger 20. Furthermore, an expansion valve 40 that expands the liquid fuel flowing to the heat exchanger 20 may be disposed between the second storage tank 18 and the heat exchanger 20.

The re-liquefaction device 34 may re-liquefy the refrigerant flowing to a separate heat pump (not shown) and the gas fuel discharged and evaporated from the second storage tank 18. The re-liquefaction device 34 may liquefy the gas fuel through the evaporation of the refrigerant.

The second storage tank 18 and the re-liquefaction device 34 may be connected by a first pipe 32*a* through which liquid fuel flows from the second storage tank 18, and a second pipe 32*b* through which gas fuel flows from the second storage tank 18. The first pipe 32*a* may be connected to a bottom of the second storage tank 18 to circulate liquid fuel stored in the second storage tank 180. The second pipe 32*b* may be connected to a top of the second storage tank 18 to circulate gas fuel vaporized in the second storage tank 18. The compressor 36 may be disposed in the second pipe 32*b* to compress the gas fuel discharged from the second storage tank 18.

The re-liquefaction device 34 may mix the liquid fuel flowing through the first pipe 32*a* and the gas fuel flowing through the second pipe 32*b*, cools it and then discharges it as the liquid fuel. The pump 38 may be disposed to supply the liquid fuel that has passed through the re-liquefaction device 34 to the heat exchanger 20.

A third pipe 32*c* may be disposed between the re-liquefaction device 34 and the heat exchanger 20 to supply the liquid fuel discharged from the re-liquefaction device 34 to the heat exchanger 20. The pump 38 may be disposed in the third pipe 32*c*. Furthermore, the expansion valve 40 may be disposed in the third pipe 32*c* to expand the liquid fuel flowing to the heat exchanger 20.

The engine system 1 may include a fourth pipe 32*d* that branches from the third pipe 32*c* and supplies the liquid fuel discharged from the re-liquefaction device 34 to the second storage tank 18. The fourth pipe 32*d* may supply the liquid fuel passing through the pump 38 on the third pipe 32*c* to the second storage tank 18.

The engine 24 is an internal combustion engine that is operated by burning compressed gas. The engine 24 may rotate the engine-side driving pulley (not shown) disposed on one side of the engine 24 through four strokes of intake, compression, explosion, and exhaust. The engine-side driving pulley may rotate the compressor-side driving pulley (not shown) connected to the compressor.

The engine 24 may include a plurality of cylinders 26 that ignite the supplied mixture to perform the reciprocating motion of the piston therein, a connecting rod (not shown) that change the reciprocating motion of the piston (not shown) into a rotary motion, and a crank shaft (not shown) that is connected to the connecting rod to be rotated.

The engine 24 may include a plurality of cylinders 26 that burn the mixture to rotate the crank shaft (not shown), an intake manifold 28 that distributes the mixture passing through a throttle valve 22 to each of the cylinders, and an exhaust manifold 30 where exhaust gases discharged from the plurality of cylinders 26 are combined and sent to the exhaust-gas heat exchanger 50 that will be described below.

A plurality of distribution paths may be formed in the intake manifold 28 to distribute the mixture supplied to the engine 24 to the plurality of cylinders, respectively, and a plurality of combination paths may be formed in the exhaust manifold 30 to be connected, respectively, to the plurality of cylinders and be combined into one exhaust path.

The mixer 12 may discharge the supplied fuel and air at a constant mixing ratio to supply the mixture to the engine. The mixer 12 may supply the mixture produced by mixing the fuel and the air at the constant ratio.

The heat exchanger 20 may perform heat exchange between the liquid fuel discharged from the second storage tank 18 and the gas supplied to the engine 24, thus vaporizing the liquid fuel. The heat exchanger 20 may perform heat exchange between the liquid fuel discharged from the second storage tank 18 and the mixture supplied from the mixer 12 to the engine 24, thus vaporizing the liquid fuel.

Figure 2:
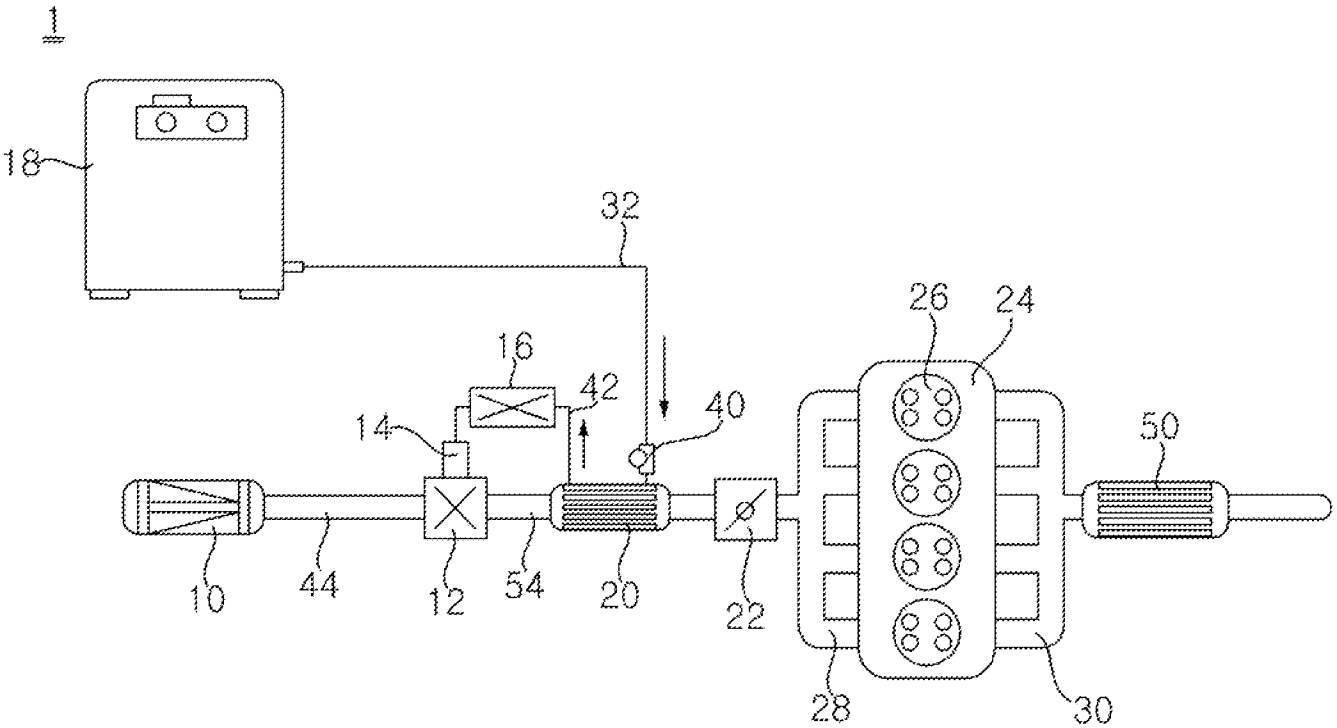
FIG. 2 is a schematic view of the engine system in accordance with the first embodiment of the present disclosure.

Referring to FIG. 2, the engine system 1 may further include an air cleaner 10 that filters air supplied to the mixer 12 to supply clean air, an expansion valve 40 that expands the liquid fuel flowing to the heat exchanger 20, a throttle valve 22 that adjusts the amount of the mixture supplied to the engine 24, and an exhaust-gas heat exchanger 50 that cools the air discharged from the engine 24.

The air cleaner 10 may prevent outside air supplied to the engine form being mixed with moisture and oil in the form of dust and mist using a filter.

The expansion valve 40 may adjust the amount of the liquid fuel discharged from the second storage tank 18 and introduced into the heat exchanger 20. The expansion valve 40 may block the refrigerant fed from the second storage tank 18 to the heat exchanger 20.

The throttle valve 22 may adjust the amount of the mixture supplied to a combustion chamber of the engine 24.

The exhaust-gas heat exchanger 50 may cool gas exhausted from the engine 24 using the coolant.

The engine system 1 includes a liquid-fuel supply pipe 32 that connects the second storage tank 18 and the heat exchanger 20, a gas-fuel supply pipe 42 that connects the heat exchanger 20 and the mixer 12, and a mixture supply pipe 54 that connects the mixer 12 and the engine 24. The engine system 1 may further include an air inlet pipe 44 connecting the air cleaner 10 and the mixer 12.

The liquid-fuel supply pipe 32 supplies the liquid fuel discharged from the second storage tank 18 to the heat exchanger 20. The expansion valve 40 may be disposed in the liquid-fuel supply pipe 32 to adjust the amount of the liquid fuel introduced into the heat exchanger 20.

The liquid-fuel supply pipe 32 supplies the liquid fuel discharged from the second storage tank 18 to the heat exchanger 60. The expansion valve 40 may be disposed in the liquid-fuel supply pipe 32 to adjust the amount of the liquid fuel introduced into the heat exchanger 60.

The liquid-fuel supply pipe 32 has a double pipe structure to prevent liquid fuel flowing therein from being vaporized, so that an insulation pipe may be disposed on the outside.

Referring to FIG. 3, the liquid-fuel supply pipe 32 may include a first pipe 32*a*, a second pipe 32*b*, a third pipe 32*c*, and a fourth pipe 32*d*.

The gas-fuel supply pipe 42 supplies the gas fuel discharged from the heat exchanger 20 to the mixer 12. The first storage tank 16 may be disposed on the gas-fuel supply pipe 42 to temporarily store the gas fuel discharged from the heat exchanger 20. The zero governor 14 may be disposed on the gas-fuel supply pipe 42 to adjust the pressure of the gas fuel introduced into the mixer 12.

The mixture supply pipe 54 connects the mixer 12 and the engine 24. The heat exchanger 20 is disposed on the mixture supply pipe 54 to perform heat exchange between the mixture flowing to the engine 24 and the liquid fuel, thus cooling the mixture.

Hereinafter, an engine system according to a second embodiment will be described with reference to FIG. 4.

Figure 4:
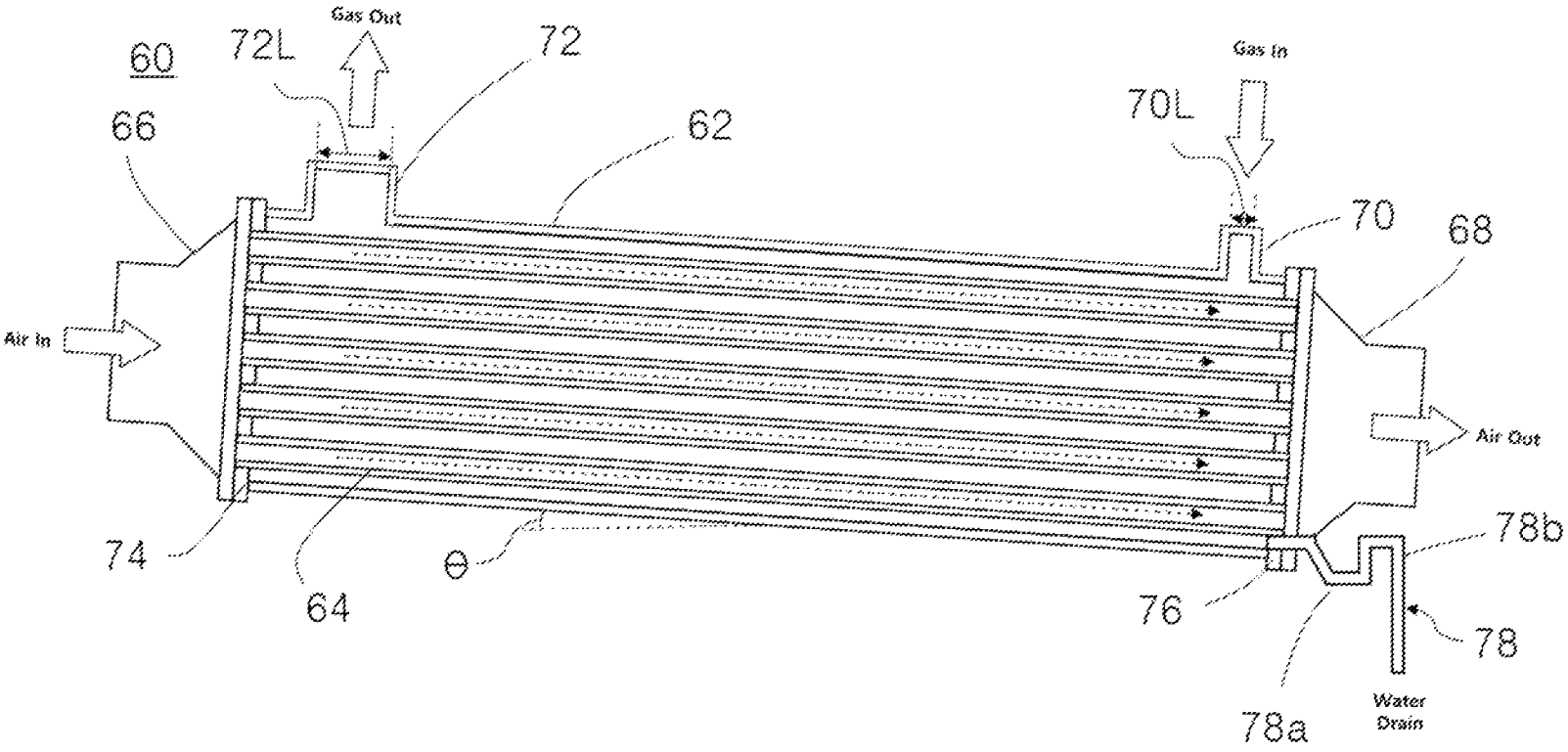
FIG. 4 is a diagram illustrating the configuration of a heat exchanger in accordance with an embodiment of the present disclosure.

Referring to FIG. 4, the engine system may further include an exhaust-gas recirculation pipe 46 that supplies some of the exhaust gas discharged from the engine 24 to the mixer 12, thus minimizing the discharge of harmful components in the exhaust gas discharged from the engine 24.

A circulation valve 52 that adjusts the flow of the exhaust gas discharged from the engine 24 may be disposed on the exhaust-gas recirculation pipe 46. The exhaust-gas recirculation pipe 46 may be connected to the air inlet pipe 44 to supply the exhaust gas to the mixer 12.

The exhaust gas flowing along the exhaust-gas recirculation pipe 46 may be mixed with air and the gas fuel in the mixer 12 to form a mixture. The temperature of the mixture produced in the mixer 12 may be increased due to the exhaust gas from the exhaust-gas recirculation pipe 46.

The heat exchanger 20 may cool the mixture fed from the mixer 12.

Referring to FIG. 4, the heat exchanger 20 may include a plurality of small-diameter pipes 64 through which the mixture flows, a housing 62 which is formed around the plurality of small-diameter pipes 64 and defines a space through which liquid fuel flows to perform heat exchange between the liquid fuel and the mixture, a first inlet pipe 66 into which the mixture flows, and a first outlet pipe 68 which collects the mixture flowing through the plurality of small-diameter pipes 64 to supply the mixture to the engine.

Referring to FIG. 4, the housing 62 may have a cylindrical shape. A second inlet pipe 70 (or inlet pipe) into which the liquid fuel is introduced and a second outlet pipe 72 (or outlet pipe) from which the gas fuel exchanging heat with the mixture to change a phase is discharged may be formed on a side of the circumferential surface of the housing 62.

The second inlet pipe 70 and the second outlet pipe 72 are disposed on a side of the circumferential surface of the housing 62. The second inlet pipe 70 and the second outlet pipe 72 may be formed on the circumferential surface of the housing 62 to protrude upwards. The introduced liquid fuel may be introduced into the housing 62 through the second inlet pipe 70 that protrudes and opens upwards. The second outlet pipe 72 may protrude and open upwards from the circumferential surface of the housing 62, so the gas fuel may be discharged through the second outlet pipe.

Referring to FIG. 4, the housing 62 may be disposed to be inclined downwards from upstream to downstream in the flow direction of the mixture. Referring to FIG. 4, the housing 62 may be disposed to be inclined from upstream to downstream in the flow direction of the mixture at an inclination angle θ. The second outlet pipe 72 may be disposed at a position higher than the second inlet pipe 70.

Referring to FIG. 4, the second outlet pipe 72 may be disposed upstream and the second inlet pipe 70 may be disposed downstream in the mixture flow direction of the housing 62, so the second outlet pipe 72 may be located at a position higher than the second inlet pipe 70. Therefore, the gas fuel which is phase-changed in the housing 62 and flows upwards may be discharged through the second outlet pipe 72.

A pipe diameter 72L of the second outlet pipe 72 may be formed to be larger than a pipe diameter 70L of the second inlet pipe 70. Fluid flowing through the second outlet pipe 72 is the phase-changed gas fuel, and may require a larger pipe diameter compared to the liquid fuel introduced through the second inlet pipe 70.

The plurality of small-diameter pipes 64 through which the mixture flows may be disposed in the housing 62. The plurality of small-diameter pipes 64 may be spaced apart from each other in centrifugal and circumferential directions in the housing 62.

Partition plates 74 and 76 may be disposed on opposite ends of the plurality of small-diameter pipes 64 of the heat exchanger 20. The partition plates may include a first partition plate 74 that partitions the inlet pipe 66 from the plurality of small-diameter pipes 64, and a second partition plate 76 that partitions the plurality of small-diameter pipes 64 from the outlet pipe 68.

A plurality of communication holes 80 connected to the plurality of small-diameter pipes 64 may be formed on the first partition plate 74 and the second partition plate 76.

A drain pipe 78 through which the condensate water of the mixture produced in the housing 62 is discharged may be disposed downstream of the housing 62 in the mixture flow direction.

Referring to FIG. 4, the first inlet pipe 66 is connected to the first partition plate 74 in an expanded state. The first inlet pipe 66 allows the mixture to smoothly flow compared to a flow rate that is reduced as it expands.

Referring to FIG. 4, the drain pipe 78 is connected at one end thereof to the second partition plate 76. The drain pipe 78 may be connected to the lower end of the second partition plate 76. A hole to which the drain pipe 78 is connected may be formed in the second partition plate 76. The drain pipe 78 includes a first drain pipe 78*a* that collects the condensate water accumulated in the housing 62, and a second drain pipe 78*b* that is disposed downstream of the first drain pipe 78*a* and is disposed above the first drain pipe 78*a* to prevent the mixture from being discharged to the drain pipe 78.

The first drain pipe 78*a* is disposed to be lower than the lower end of the housing 62. Therefore, the condensate water accumulated in the housing 62 may be introduced into the first drain pipe 78*a*. The second drain pipe 78*b* is disposed downstream of the first drain pipe 78*a*, and is disposed above the first drain pipe 78*a*. Therefore, the condensate water accumulated in the housing 62 is collected in the first drain pipe 78*a*, so the mixture is not discharged to the outside through the drain pipe 78. Hereinafter, an engine system according to a third embodiment will be described with reference to FIG. 5.

Figure 5:
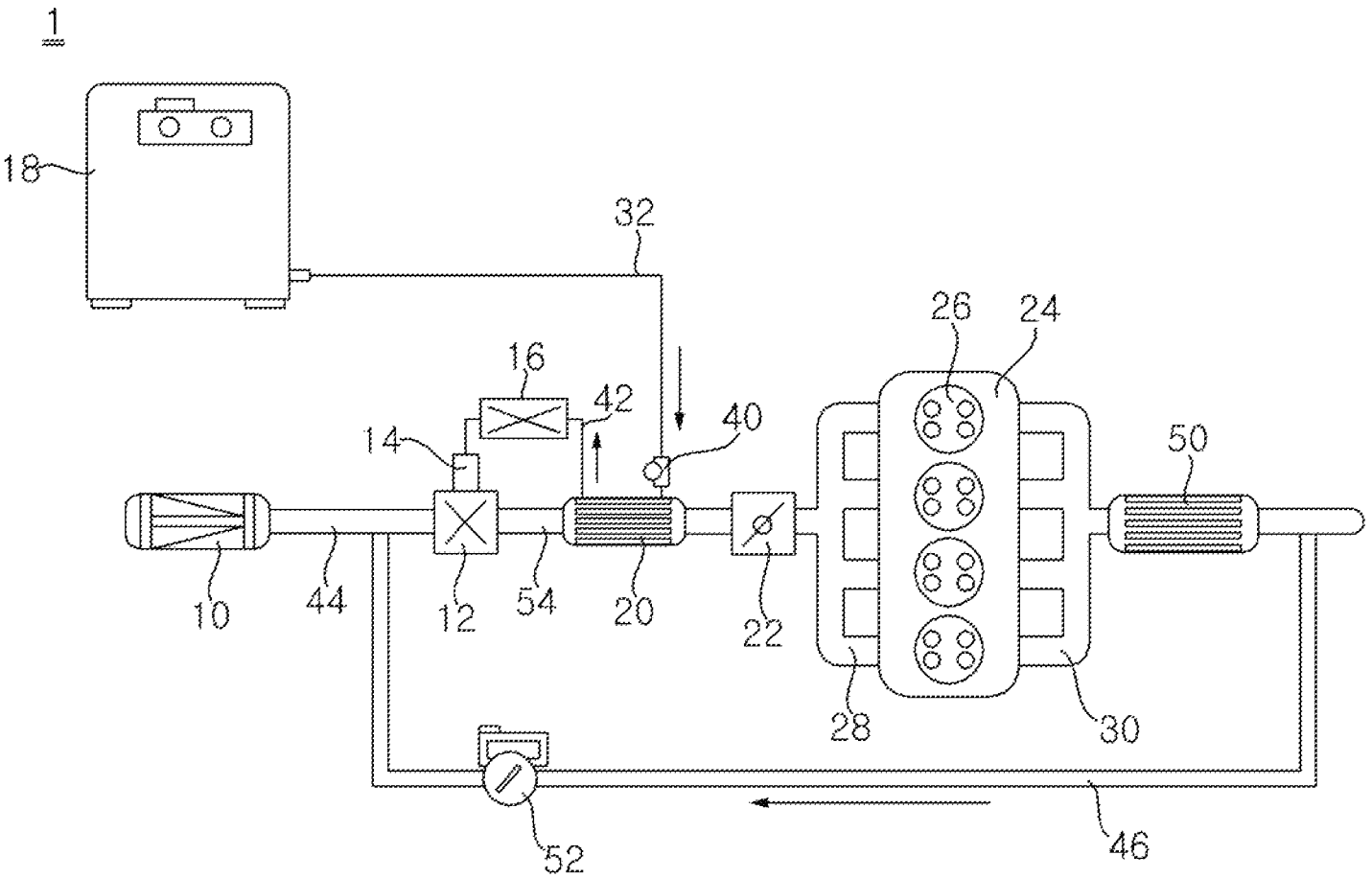
FIG. 5 is a schematic view of an engine system in accordance with a second embodiment of the present disclosure.

Referring to FIG. 5, a supercharger 48 may be disposed to compress the mixture flowing between the mixer 12 and the heat exchanger 20. The mixture passing through the supercharger 48 may be compressed to be formed at a high temperature and a high pressure.

The heat exchanger 20 may cool the mixture of high temperature passing through the supercharger 48. In the heat exchanger 20, heat exchange occurs between the mixture and the liquid fuel. In the heat exchanger 20, the mixture may be changed from a high-temperature state to a low-temperature state, and the liquid fuel may be phase-changed into the gas fuel.

The supercharger 48 of FIG. 5 may be configured to drive a turbine using the exhaust gas discharged from the engine 24, and thereby compress the mixture flowing from the mixer 12 with an impeller rotated by the turbine or compress the mixture using a separate power.

Hereinafter, engine systems 1 according to fourth and fifth embodiments will be described with reference to FIGS. 6 and 7. In the engine systems according to the fourth and fifth embodiments, the heat exchanger 20 may be disposed on the exhaust-gas recirculation pipe 46.

Figure 6:
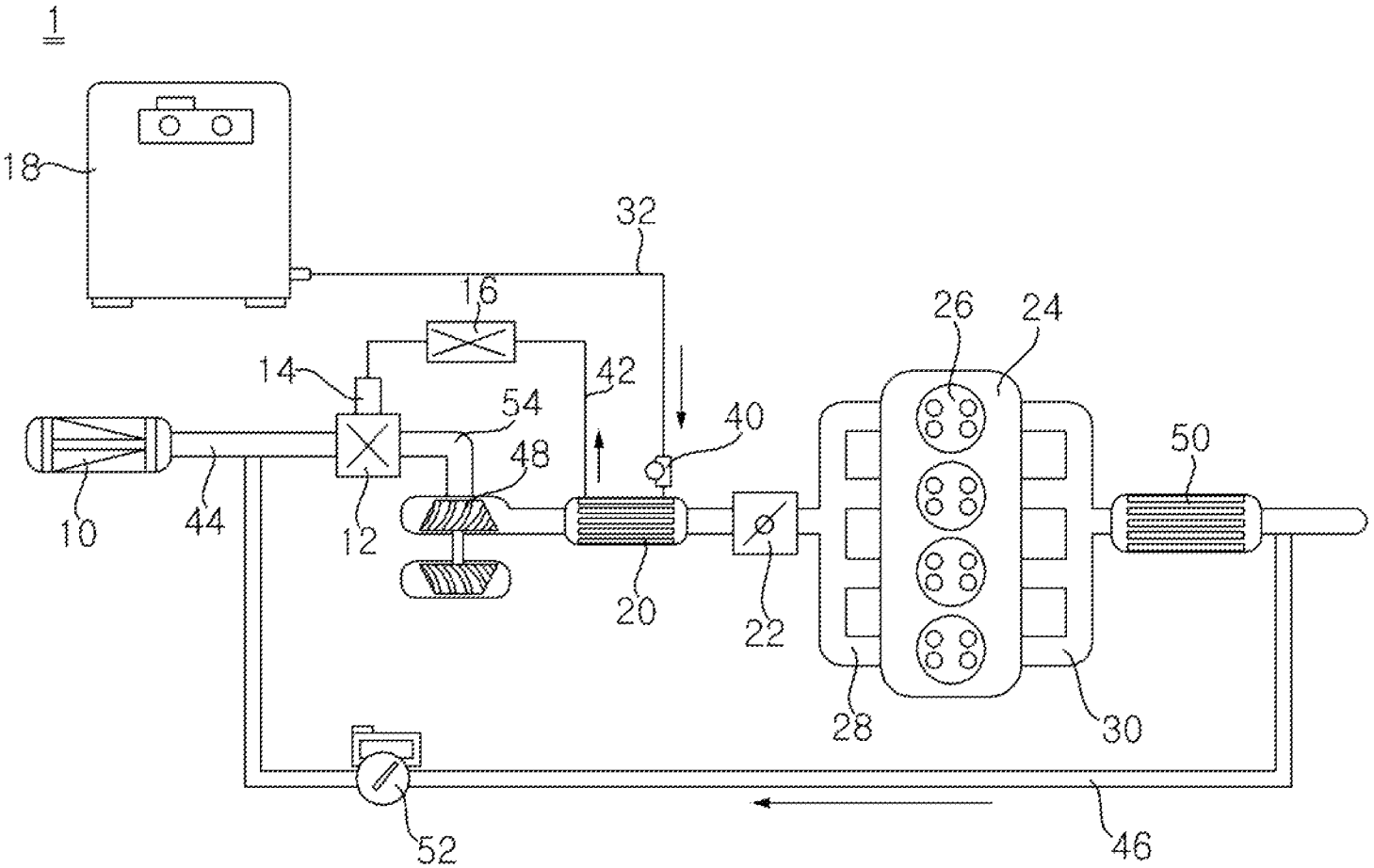
FIG. 6 is a schematic view of an engine system in accordance with a third embodiment of the present disclosure.

Referring to FIG. 6, the engine system 1 includes an exhaust-gas recirculation pipe 46 that minimizes the discharge of harmful components in the exhaust gas discharged from the engine 24. The heat exchanger 20 is disposed on the exhaust-gas recirculation pipe 46.

The heat exchanger 20 performs heat exchange between exhaust gas flowing through the exhaust-gas recirculation pipe 46 and liquid fuel discharged from the second storage tank 18. The exhaust gas flowing through the heat exchanger 20 in the exhaust-gas recirculation pipe 46 may be cooled. The liquid fuel discharged from the second storage tank 18 through the heat exchanger 20 may be vaporized and then supplied to the first storage tank 16.

Therefore, the exhaust gas discharged from the heat exchanger 20 may be mixed with air while the temperature of the exhaust gas is reduced, and then may be supplied to the mixer.

Figure 7:
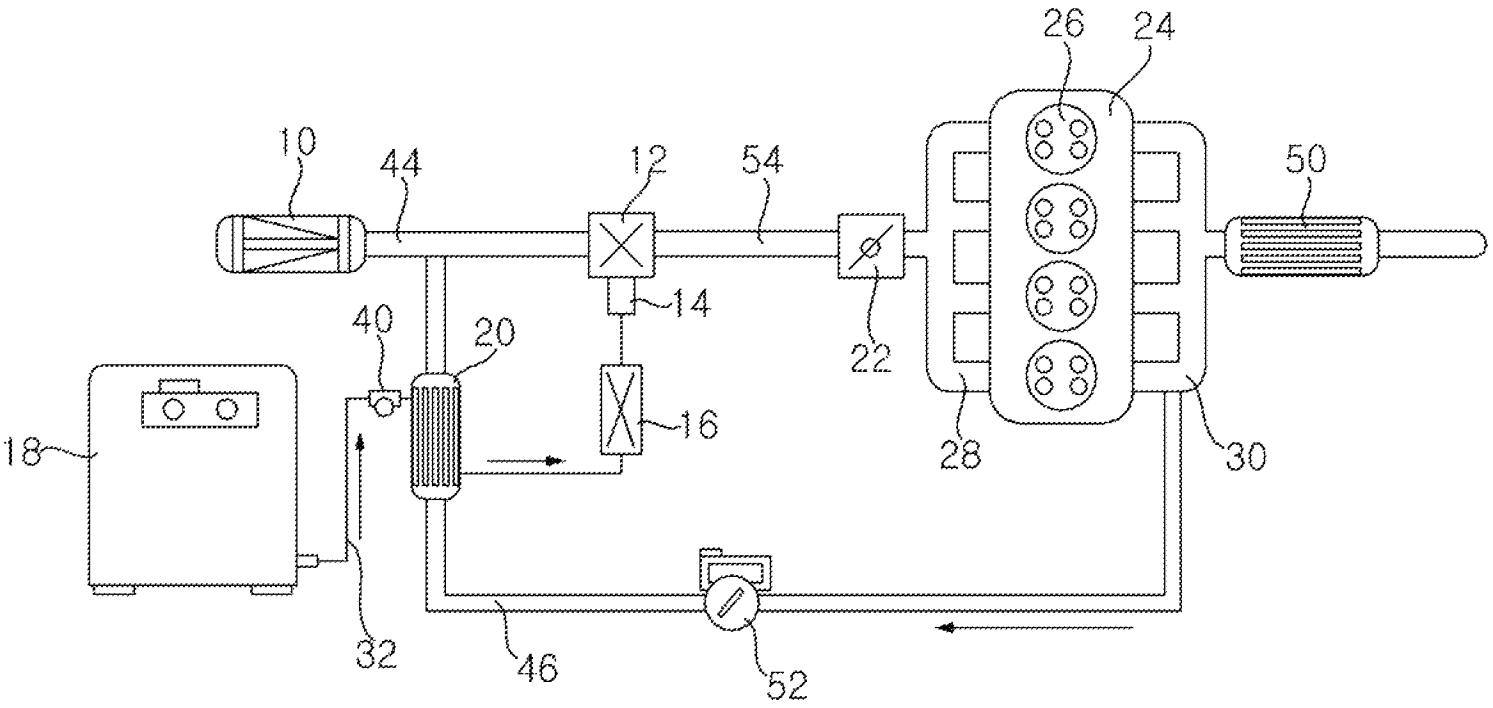
FIG. 7 is a schematic view of an engine system in accordance with a fourth embodiment of the present disclosure.
Figure 8:
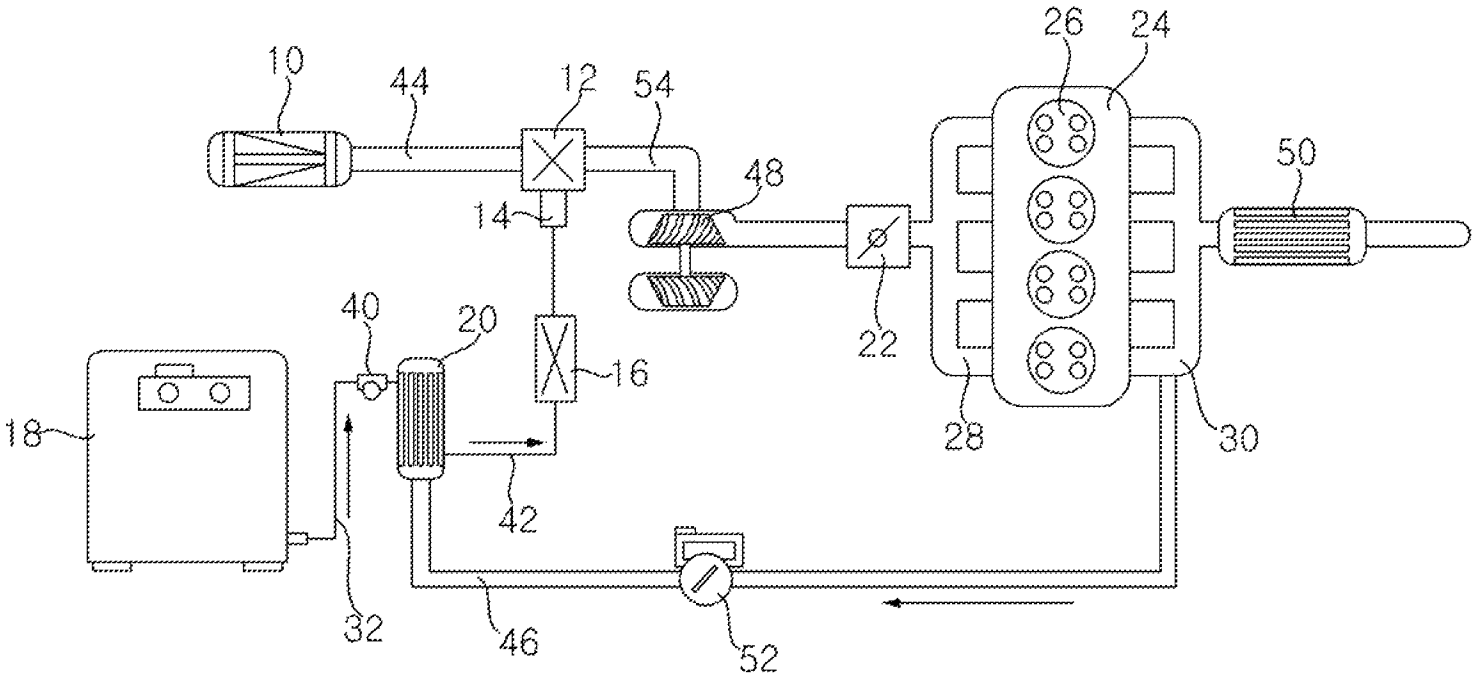
FIG. 8 is a schematic view of an engine system in accordance with a fifth embodiment of the present disclosure.

Referring to FIG. 7, a supercharger 48 may be disposed to compress the mixture fed from the mixer 12 to the engine 24. The heat exchanger 20 performs heat exchange between the exhaust gas flowing through the exhaust-gas recirculation pipe 46 and the liquid fuel discharged from the second storage tank 18.

Although the present invention was described with reference to specific embodiments shown in the drawings, it is apparent to those skilled in the art that the present invention may be changed and modified in various ways without departing from the scope of the present invention, which is described in the following claims.

An engine system according to the present disclosure has the following effects.

First, it is advantageous in that the temperature of a mixture supplied to an engine is reduced using a phase change in fuel supplied to the engine, so the performance of the engine can be maximized.

Second, it is advantageous in that it is possible to cool fuel supplied to an engine using only fuel supplied to the engine, without a separate refrigerant or coolant for cooling.

Third, it is advantageous in that the performance of an engine can be maximized by reducing the temperature of exhaust gas supplied through exhaust gas recirculation and then recirculating the exhaust gas to the engine, using a phase change in fuel supplied to the engine.

The effects of the present disclosure are not limited to the above-described effects, and it should be understood to cover all effects that can be inferred from the configuration described in the detailed description or claims of the present disclosure.

What is claimed is:

1. An engine system, comprising:

a mixer that mixes air and vaporized fuel to form a mixture;

an engine that drives a cylinder with the mixture discharged from the mixer;

a first storage tank that supplies the vaporized fuel to the mixer;

a second storage tank storing that stores liquid fuel and supplies the stored liquid fuel to the first storage tank;

a heat exchanger that performs heat exchange between the liquid fuel discharged from the first storage tank and gas flowing to the engine, thus vaporizing the liquid fuel; and an expansion valve that expands the liquid fuel discharged from the second storage tank and supplied to the heat exchanger.

2. The engine system of claim 1, wherein the heat exchanger is disposed between the mixer and the engine to perform heat exchange between the mixture fed from the mixer to the engine and the liquid fuel flowing from the second storage tank to the first storage tank.

3. The engine system of claim 2, further comprising:

a supercharger that compresses the mixture flowing from the mixer to the engine, wherein the heat exchanger is disposed between the supercharger and the engine to reduce a temperature of the mixture flowing to the engine.

4. The engine system of claim 2, further comprising:

an exhaust-gas recirculation pipe defining a recirculation path to supply gas discharged from the engine to the mixer.

5. The engine system of claim 4, wherein the exhaust-gas recirculation pipe is connected to an air inlet pipe that supplies air to the mixer.

6. The engine system of claim 1, further comprising:

a re-liquefaction device that liquefies fuel discharged from the second storage tank; and a pump that supplies the fuel, discharged from the re-liquefaction device, to the heat exchanger.

7. The engine system of claim 6, further comprising:

a first pipe connected to a bottom of the second storage tank to send the liquid fuel stored in the second storage tank to the re-liquefaction device; and a second pipe connected to a top of the second storage tank to send the gas fuel discharged from the second storage tank to the re-liquefaction device.

8. The engine system of claim 7, wherein a compressor is disposed in the second pipe to compress the gas fuel introduced into the re-liquefaction device.

9. The engine system of claim 7, further comprising:

a third pipe that connects the re-liquefaction device and the heat exchanger; and a fourth pipe that branches from the third pipe and is connected to the second storage tank.

10. The engine system of claim 9, wherein the pump is disposed on the third pipe before the fourth pipe is branched.

11. The engine system of claim 10, wherein the expansion valve is disposed on the third pipe after the fourth pipe is branched.

12. The engine system of claim 1, further comprising:

an exhaust-gas recirculation pipe defining a recirculation path to supply gas, discharged from the engine, to the mixer, wherein the heat exchanger is disposed on the exhaust-gas recirculation pipe so that the liquid gas exchanges heat with the exhaust gas flowing in the recirculation path to be vaporized.

13. The engine system of claim 12, wherein the exhaust-gas recirculation pipe is connected to the air inlet pipe that supplies air to the mixer, and further comprising a supercharger compressing the mixture flowing from the mixer to the engine.

14. The engine system of claim 1, further comprising:

a zero governor that supplies the gas fuel stored in the first storage tank to the mixer at a predetermined pressure.

15. The engine system of claim 1, wherein the heat exchanger comprises:

a plurality of small-diameter pipes in which gas flowing to the engine flows; and a housing formed around the plurality of small-diameter pipes, and defining a space in which liquid fuel flows so that heat exchange is performed between the liquid fuel and the mixture, wherein an inlet pipe and an outlet pipe are formed on a side of a circumferential surface of the housing, wherein the liquid fuel is introduced into the inlet pipe, and wherein the gas fuel exchanges heat with gas that flows in the plurality of small-diameter pipes to discharge phase-changed gas fuel.

16. The engine system of claim 15, wherein the housing is disposed to be inclined downwards from upstream to downstream in a flow direction of the gas flowing to the engine, and wherein the inlet pipe and the outlet pipe are formed on the circumferential surface of the housing to protrude upwards.

17. The engine system of claim 16, wherein the outlet pipe is disposed at a position higher than the inlet pipe.

18. The engine system of claim 15, wherein the heat exchanger further comprises a drain pipe that is disposed downstream of the housing in the flow direction of the gas flowing to the engine and discharges condensate water of the mixture produced in the housing.

19. The engine system of claim 18, wherein the drain pipe comprises a first drain pipe that collects the condensate water accumulated in the housing, and a second drain pipe that extends to be disposed above the first drain pipe so as to prevent the gas flowing to the engine from being discharged to the drain pipe, wherein the first drain pipe is disposed to be lower than a lower end of the housing, and wherein the second drain pipe is disposed downstream of the first drain pipe and above the first drain pipe.

* * * * *